United States Patent [19]

Deweese

[11] Patent Number: 4,687,154

[45] Date of Patent: Aug. 18, 1987

[54] DEVICE FOR HANDLING AND STORAGE OF EXTENSION CORDS AND THE LIKE

[75] Inventor: Richard A. Deweese, Knoxville, Tenn.

[73] Assignee: University of Tennessee Research Corporation, Knoxville, Tenn.

[21] Appl. No.: 800,466

[22] Filed: Nov. 21, 1985

[51] Int. Cl.[4] ..... B65H 75/40

[52] U.S. Cl. ..... 242/96; 242/85.1; 242/115

[58] Field of Search ..... 242/85.1, 86, 96, 110, 242/115, 110.3, 129

[56] References Cited

U.S. PATENT DOCUMENTS

| | | | |
|---|---|---|---|
| 1,252,483 | 1/1918 | Pattison | 242/110.3 |
| 2,138,299 | 11/1938 | Gruebel | 242/85.1 |
| 2,423,533 | 7/1947 | Turner | 242/85.1 |
| 2,427,801 | 9/1947 | McKee | 242/85.1 |
| 2,554,897 | 5/1951 | Chapman | 242/85.1 |
| 2,677,510 | 5/1954 | Osborne | 242/96 |
| 2,747,812 | 5/1956 | Lassen | 242/110 |
| 3,290,453 | 12/1966 | Jensen | 242/85.1 X |
| 4,123,012 | 10/1978 | Hough | 242/85.1 |
| 4,261,529 | 4/1981 | Sandberg | 242/85.1 |
| 4,277,035 | 7/1981 | Gaski | 242/85.9 |
| 4,577,809 | 3/1986 | Auer | 242/96 |
| 4,586,675 | 5/1986 | Brown | 242/96 X |

FOREIGN PATENT DOCUMENTS

| | | | |
|---|---|---|---|
| 14993 | of 1929 | Australia | 242/110.3 |
| 838133 | 2/1939 | France | 242/85.1 |

*Primary Examiner*—Stuart S. Levy
*Assistant Examiner*—Katherine Matecki
*Attorney, Agent, or Firm*—Luedeka & Neely

[57] ABSTRACT

A unitary lightweight, inexpensive, simple telescoping frame is provided for handling and storing an extension cord or similar flexible line in a figure eight configuration. The device eliminates the tangling and twisting associated with the use of such cords and provides convenient, flat, hanging storage and presents the cord so that it can be readily payed out and extended with substantially no resistance or tangling.

1 Claim, 5 Drawing Figures

DEVICE FOR HANDLING AND STORAGE OF EXTENSION CORDS AND THE LIKE

This invention relates to a frame and method for handling and storing extension cords and similar flexible lines such as air hoses, water hoses, rope and wire in a figure eight configuration.

Many households now use long extension cords to power hedge clippers, weed cutters, and other household items. The most common handling of such extension cords results in tangling and twisting and haphazard storage. Untangling is usually required and a great deal of resistance to the cord being extended is encountered when the cord is being deployed for use.

In the past, handling and storage devices and methods have utilized hand cranked reels, spring load self-winding reels and square frames for manual winding.

Also, the prior art has shown a method and apparatus for a garden hose and the like using a carrier for winding the strand in a figure eight configuration which is hinged in the middle to fold the figure eight into a circle.

It is the object of this invention to provide a unitary, lightweight, inexpensive, simple telescoping frame and method for the handling and storage of extension cords and the like in a flat figure eight configuration. The invention provides a convenient storage means that can be readily hung in a garage or utility room and carried to a place of use where it can be telescopically collapsed and freed from the cord to permit it to be payed out and extended with substantially no resistance or tangling.

The invention can also be used with other flexible lines such as hoses, rope and wire.

Other objects and advantages of the invention will become apparent by reference to the following description including the accompanying drawing in which.

Figure 2:
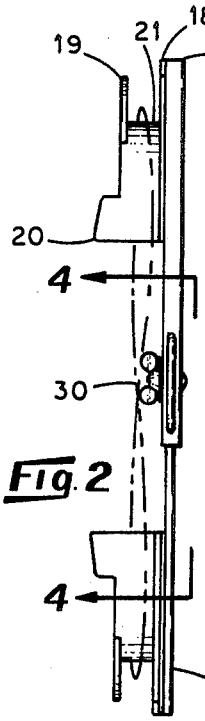
FIG. 2 is a side view of FIG. 1.

Referring to the FIGURES a frame 10 is provided having a telescoping central member or backbone member 11. The central member has an outer telescoping member 12 with an inner telescoping member 13. These two telescoping members are similar are a flat "C" shape in cross-section with a linear opening 31 in the outer telescoping member and a parallel linear opening 32 in the inner telescoping member. The outer telescoping member is fastened to an arcuate end piece 14 by suitable means such as rivets or welding or by being molded integral therewith as best shown in FIG. 2. An identical arcuate end piece is also fixed to the inner telescoping member but since the two arcuate end pieces are identical only the one fixed to the outer telescoping member will be described in detail.

The arcuate end piece has a flat middle section 15 which extends transverse to the central member. This need not be flat and could be more arcuate shaped similar to the top of a normally drawn FIG. 8 if desired. However, the flat section is preferred since it permits the frame to be set on its end without a tendency to roll to one side or the other so the extended back wall 18 should have a straight outermost edge of substantial width to prevent rolling and to space the end of the coiled cord 29 from the ground. The flat middle section at each end gradually turns downward to define the outermost width of the frame or tangent section 40 and then curves inward as an inward curved section 41 to approximately follow the curve of a normal figure eight. Broadly, the arcuate end piece is a channel for holding the extension cord in place with a front wall 19, back wall 18 and bottom 21 of a flat middle section. The front wall 19 transverses only to the bottom 16 of the tangent section, so there is no front wall to either the tangent section 40 or inward curved section 41.

Figure 5:
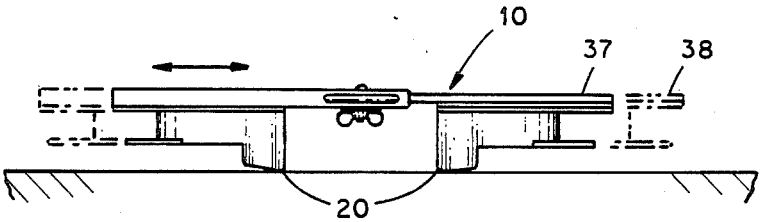
FIG. 5 is a schematic view showing a side view of the frame of FIG. 1 resting on the projection legs in a collapsed position and, as shown by the dotted lines, extended position.

The bottom 17 of inward curve section 41 projects outwardly to the front to form a bottom width extender or projection legs 20 as best seen in FIGS. 2 and 5. The projection legs serve two purposes. One they provide a bottom width extender since the figure eight coil forms a wider package as it approaches the center or cross-over point 30 of the figure eight loop and is approximately three inches tall at the center of the loop versus the two inch width of the bottom of the middle section 21. It can be appreciated that a full bundle or coil such as 125 feet of three-eighths inch cord as used with the preferred embodiment shown in the drawings, would cross over one another at the center of the figure eight forming a thicker coil. This cross-over point is also the center of the frame 10. This is not twice as thick since the coils do not lay exactly parallel but is approximately 50% thicker. The second purpose of the projection legs is to form four legs as shown in FIG. 5 when the storage device is set down on its face preliminarily to paying out the cord as will be explained further later when the operation is described.

Welded or otherwise affixed to the outer telescoping member 12 at the vicinity of the center are two stabilizers which also function as carrying handles 22. The stabilizers are mounted at the back section of the frame directly under the center of the figure eight so that a foot can be placed thereon to hold it to the ground and stabilize it while the coil is being made. After the coil has been made the stabilizer functions as a carrying handle and because of its center location it is well balanced for such purpose.

Figure 3:
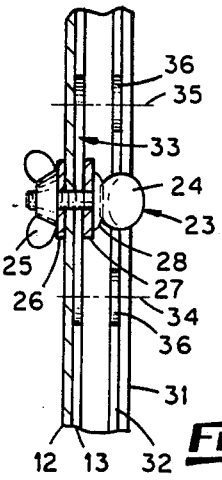
FIG. 3 is a partially sectional view of section 3—3 of FIG. 1.
Figure 4:
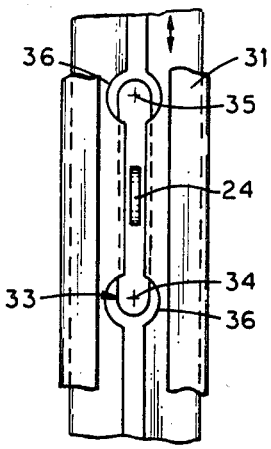
FIG. 4 is a broken out sectional view of section 4—4 of FIG. 2.

The inner telescoping member 13 and outer telescoping member 12 are held together by a thumb screw and wing nut lock 23 as best seen in FIGS. 2, 3 and 4. The lock rides in a slot opening 33 in the forward face of the inner telescoping member and has an upper and lower end to define the limits of the movement of the telescoping action as the frame is extended and collapsed. As stated earlier, the inner and outer telescoping members are in cross-section akin to flattened "C"-shapes with the opening of the "C" being a linear opening 31 in the outer telescoping member which runs its entire length. Parallel with this opening in the linear opening 32 in the inner telescoping member which also runs for the entire length of such telescoping member. This linear opening 32 has an upper and lower enlargement 36 to accommodate the thumb screw portion of the lock 23.

The two enlargements 36 have centers 34 and 35 respectively located at the lower and upper ends respectively coaxial with the ends of the slot 33. The thumb screw and wing nut lock 23 is made up of a thumb screw 24 that has an enlarged head that is flattened so that its thickness can ride in the linear opening 32 of the inner telescoping member and is prevented from twisting because the width of the thumb screw is greater than the width of the slot. The enlargements 36 are of a diameter that permits the thumb screw to be rotated in the event it is desirous to disassemble the frame. The thumb screw 24 has an enlarged shoulder 28 contacting a thumb screw washer 27 whose diameter is larger than the width of the slot 33 and rests at the edge of the slot when tightened to provide resistance to the tightening forces and clamp the inner telescoping member's front wall to the front wall of the outer telescoping member. A wing nut washer 26 is screwed onto the thumb screw 24 and is supported by a wing nut washer 26 which is concentric with the hole slightly larger than the diameter of the screw portion of the thumb screw positioned in the front wall of the outer telescoping member. Thus, as the thumb screw is tightened, the thumb screw washer clamps the front wall of the outer telescoping member to the front wall along the slot of the inner telescoping member. When the thumb screw is loosened, the clamping forces are released and the inner end outer telescoping members are free to telescope to an extended or collapsed condition, the extremes of which are controlled by the ends of the slot 33.

As shown in FIG. 5, the frame is placed face down prior to paying out a cord wound thereon. In such position it rests on extensions or projection legs 20 and the preloosened thumb screw permits the frame to collapse from the extended position 38 shown in dotted lines to collapsed position 37. This collapsing is sufficient to be greater than the depth of the arcuate end pieces as defined by the front wall 19 so the wound cord can drop to the ground but still be in its figure eight configuration. The frame is then removed and extended for the rewinding of the cord when desired. The frame does not necessarily have to be fully extended since as shown in FIGS. 2, 3 and 4, it is in an intermediate position. Once rewound onto the frame, the frame with rewound cord can be hung from the wall with hanging hole 39 or set against a wall on the flat width of back wall 18.

The preferred embodiment has just been described in detail. The dimensions of this preferred embodiment are that when the frame is fully extended it is thirty-five inches high and twenty-three and one-half inches wide and the maximum amount of collapsing is five inches or to a thirty inch height. The width is approximately eighteen inches wide between the bottoms 16 of the tangent sections 40. The back walls of the tangent section is approximately two and one-fourth inches wide or deep. The back wall of the flat middle section 15 is approximately three and one-half inches wide or deep with the front wall being approximately two and one-fourth inches deep or wide so that the supported coil can be approximately two and one-fourth inches deep at the end. The width of the channel is determined by the bottom 21 of the middle section which is two inches wide. The thickness of the bottom and walls of the arcuate end pieces 14 is three-sixteenths inch of plastic but can be thinner, such as one-eighth inch thick. The entire frame can be molded or assembled from plastic or aluminum or other similar materials. The transverse width of the flat middle section 15 is approximately fourteen inches along the flat.

The outer telescoping member is approximately two and three-fourths inches wide by seven-eighths inch deep. The outer telescoping member is approximately twenty-one and three-fourths inches long including the portion extending up the back of the arcuate end piece. The inner telescoping member is approximately two and one-fourth inches wide by one-half inch deep or thick. It is approximately twenty-one and one-half inches long including the portion that extends to the back of the arcuate end piece.

The wound extension cord 29 is 125 feet long by three-eighths inch diameter. As said earlier, it is thicker at the cross-over point 30 by approximately 50% than at the ends of the figure eight. The projection legs 20 stand approximately three and three-fourths inches tall from the inside of the back wall. The slot 33 is approximately one-fourth inch wide and is five inches long between centers 35 and 34. The linear opening 32 is approximately one-eighth inch wide. The center 35 is approximately two inches from the end of the inner telescoping member.

The above dimensions are given so that the relative size and functional interrelationship of the parts can be better understood. It is also to be understood that these dimensions can be changed as appropriate for other embodiments of the invention.

The operating sequence for the use of the device and its method of use starts from the position where the frame with the figure eight coil is hanging on the wall in an extended position and locked in place. It is removed from the wall and the the thumb screw and wing nut lock loosened and it is laid face down onto the ground and the frame collapsed with the collapsing sufficient that the front wall 19 of the arcuate end pieces clears the coil and the frame is removed. At this time the frame can be extended and locked before being placed aside. The top most coil which is preferably the outermost female end of the coil can be pulled out in the direction of use. If desired, the other end of the cord, which is at the bottom of the coil, can be plugged into a suitable outlet. The topmost layers of the cord are played out smoothly and with minimum resistance and substantially no kinking or tangling.

Figure 1:
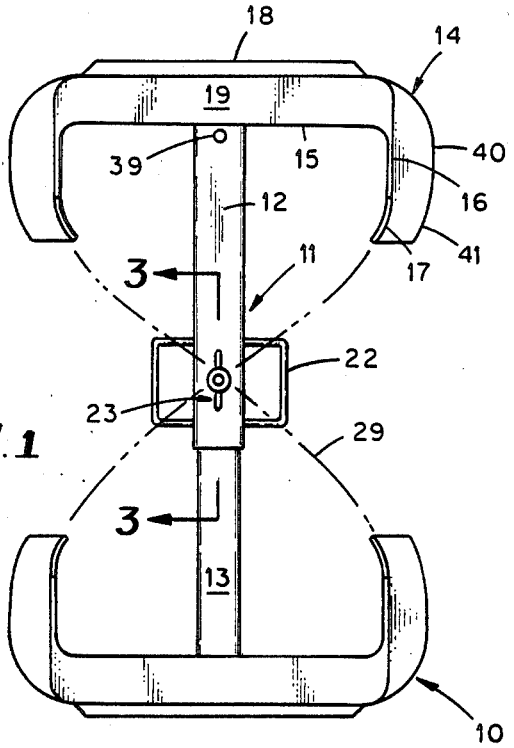
FIG. 1 is a plan view of the telescoping frame.

When it is desired to rewind the cord after use, first the frame is extended and the thumb screw and wing nut lock tightened if such was not done earlier and placed with its back on the ground so that the stabilizers 22 are substantially flat with the ground. The cord has the outermost or female end pulled into the coiling area to prevent having to drag against too much resistance during the coiling operation itself. Then the male portion or the plug, which has already been unplugged, is pulled into the coiling area. The female end is first laid onto the frame and then the cord is wound in a figure eight pattern as shown in FIG. 1 onto the frame until all of its length has been assembled into the coil. Since the frame is light-weight and may be shifted during the coiling operation, a foot can be placed on the stabilizer 22 to hold the frame in position and the coil is being made. The figure eight is an excellent configuration since it prevents twist and separates the layers. After the figure eight coil has been completely made, the frame can then be hung on the wall or set in some suitable location. There are no special tie-downs required to hold the coil onto the frame.

While a preferred embodiment of the invention is shown and described, it will be understood that there is not intent to limit the invention by such disclosure, but rather it is intended to cover all modifications and alternate constructions falling within the spirit and scope of the invention as defined in the appended claims.

What is claimed is:

1. A lightweight frame for handling and storing cord or the like in a figure eight configuration comprising:

a telescoping backbone having two ends;

a transversely extending arcuate end piece fastened to each end of said telescoping backbone;

each of said arcuate end pieces having a middle section with two ends;

said middle section having a bottom, a front wall, and a rear wall to define a U-shaped channel sufficient in size to accommodate a stored cord or the like;

said middle section rear wall having an outer edge which is straight to permit standing of the frame without rolling;

a tangent section extending from each of said ends of said arcuate end pieces in a direction parallel to said telescoping backbone;

each of said tangent sections having only a rear wall and a bottom with said bottom having a width approximately the same width as said bottom of said middle section;

an inward curved section extending from each of said tangent sections in a direction toward the center of said frame;

each of said inward curved sections having only a bottom and a rear wall;

a projection leg extending forwardly from said bottom of said inward curved section to serve both to increase the width of said bottom of said inward curved section and to serve as a support for said frame when it is placed face down on a horizontal surface; and an open handle-shaped transversely extending footplate affixed to said backbone at approximately the middle thereof to serve both as a carrying handle and a hold down for said frame when a cord or the like is being wound thereon.

* * * * *